United States Patent [19]

Matsubayashi et al.

[11] Patent Number: 4,481,396

[45] Date of Patent: Nov. 6, 1984

[54] COMBINATION MICROWAVE AND CONVECTION OVEN

[75] Inventors: Kazuyuki Matsubayashi, Amagasaki; Koichi Tateda, Yao, both of Japan

[73] Assignee: Sharp Kabushiki Kaisha, Osaka, Japan

[21] Appl. No.: 477,644

[22] Filed: Mar. 22, 1983

Related U.S. Application Data

[63] Continuation of Ser. No. 255,093, Apr. 17, 1981, abandoned.

[30] Foreign Application Priority Data

Apr. 22, 1980 [JP] Japan ..... 55-53708

[51] Int. Cl.[3] ..... H05B 6/64

[52] U.S. Cl. ..... 219/10.55 B; 219/10.55 R; 219/400; 126/21 A

[58] Field of Search ..... 219/10.55 R, 10.55 B, 219/10.55 E, 400; 126/21 A, 21 R

[56] References Cited

U.S. PATENT DOCUMENTS 2,898,437 8/1959 McFarland ..... 219/400 X
4,010,341 3/1977 Ishammar ..... 126/21 A X
4,068,572 1/1978 Vogt ..... 219/400 X
4,096,369 6/1978 Tanaka et al. ..... 219/10.55 R X
4,283,614 8/1981 Tanaka et al. ..... 219/10.55 R

FOREIGN PATENT DOCUMENTS 53-148740 12/1978 Japan ..... 219/10.55 B

*Primary Examiner*—P. H. Leung
*Attorney, Agent, or Firm*—Birch, Stewart, Kolasch & Birch

[57] ABSTRACT

A cooking apparatus for performing a microwave cooking operation and a convection cooking operation wherein heated air is circulated in an oven cavity. An air intake aperture is formed at the center of the ceiling wall of the oven cavity. The air removed through the air intake aperture is heated up by a heater and reintroduced into the oven cavity through a first blowoff aperture which is positioned at the corner of the ceiling wall near a right side wall of the oven cavity, and through a second blowoff aperture which is asymmetrically positioned at the lower portion of a left side wall of the oven cavity.

6 Claims, 2 Drawing Figures

COMBINATION MICROWAVE AND CONVECTION OVEN

This application is a continuation of copending application Ser. No. 255,093, filed on Apr. 17, 1981 under 37 CFR 1.62, now abandoned.

BACKGROUND AND SUMMARY OF THE INVENTION

The present invention relates to a cooking apparatus of the heated air circulating type.

The conventional cooking apparatus of the heated air circulating type includes a heated air blowoff aperture for supplying heated air into an oven cavity and an intake aperture for taking out air from the oven cavity for recirculation purposes. Both the heated air blowoff aperture and the intake aperture are formed in the ceiling wall of the oven cavity and, therefore, a uniform cooking is not ensured. Further problems occur when a double stage tray is employed, because the foodstuff mounted on the lower tray does not receive a sufficient amount of the heated air.

An improvement is proposed in U.S. Pat. No. 2,898,437, COMBINATION ELECTRIC COOKING APPLIANCE, by Donald L. McFarland, which was issued on Aug. 4, 1959. In the appliance disclosed in U.S. Pat. No. 2,898,437, the heated air blowoff aperture is formed at the corner of the ceiling wall, and the intake aperture is formed in the lower section of the side wall of the oven cavity. Even in such an appliance, a uniform flow of the heated air in the oven cavity is not ensured.

Accordingly, an object of the present invention is to provide a cooking apparatus of the heated air circulating type, which ensures uniform cooking.

Another object of the present invention is to locate a heated air blowoff aperture and an intake aperture at the most preferable positions to ensure a uniform cooking in a cooking apparatus of the heated air circulating type.

Still another object of the present invention is to provide a heated air circulating system for ensuring uniform cooking in a cooking apparatus of the heated air circulating type including a double stage tray.

Yet another object of the present invention is to provide a combined cooking apparatus of a microwave oven and a cooking apparatus of the heated air circulating type.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, an intake aperture is formed at the center of the ceiling wall of the oven cavity. A first blowoff aperture is formed in the ceiling wall at one edge thereof contacting a right side wall of the oven cavity. A second blowoff aperture is formed at the lower section of a left side wall of the oven cavity. The second blowoff aperture is located at a height slightly above the lower tray of a double stage tray, thereby effectively supplying the heated air to the foodstuff mounted on the lower tray.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
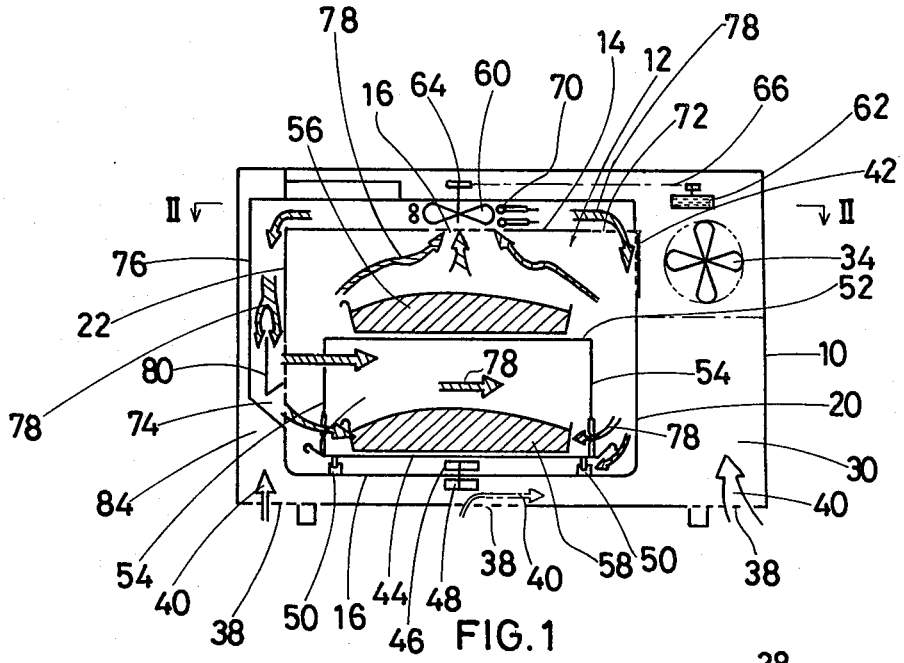
FIG. 1 is a sectional view of an embodiment of a cooking apparatus of the heated air circulating type of the present invention (taken along line I—I of FIG. 2)
Figure 2:
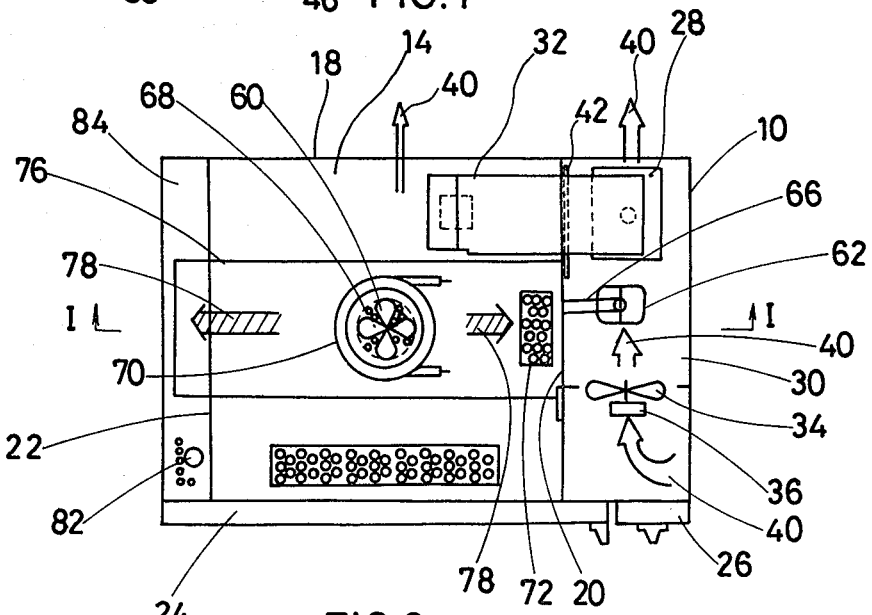
FIG. 2 is a partially sectional view taken along line II—II of FIG. 1.

A cooking apparatus of the present invention includes a housing 10 and an oven cavity 12. The oven cavity 12 is surrounded by a ceiling wall 14, a bottom wall 16, a rear wall 18, a right side wall 20, a left side wall 22, and an oven door 24 rotatably secured at the front face of the cooking apparatus.

A control panel 26 is disposed at the right portion of the front face of the cooking apparatus for introducing a cooking command into a control circuit disposed at the back of the control panel 26.

A magnetron 28 is disposed in a clearance 30 provided between the housing 10 and the right side wall 20 for performing the microwave cooking. The microwave energy generated by the magnetron 28 is supplied to the oven cavity 12 through a waveguide 32 which is secured to the ceiling wall 14. A cooling fan 34 and a fan motor 36 are disposed in the clearance 30 to cool the magnetron 28 when microwave cooking is being performed. More specifically, the cooling fan 34 functions to introduce fresh air from the environment through openings 38 formed in the bottom wall of the housing 10, thereby creating an air flow shown by arrows 40, which is discharged through openings formed at the rear wall of the housing 10. When desired, in the microwave cooking operation, the fresh air is introduced into the oven cavity 12 via a damper 42 as is well known in the art of the microwave oven.

An enamel coated metal turntable 44 is disposed at a bottom section of the oven cavity 12. The turntable 44 is removably coupled to a drive coupler 46 which is geared to a turntable drive motor 48. The turntable drive motor 48 is disposed in a clearance formed between the housing 10 and the bottom wall 16 of the oven cavity 12. Supporting rollers 50 are secured to the bottom wall 16 for ensuring a smooth rotation of the enamel coated metal turntable 44.

An upper tray 52 includes a plurality of supporting legs 54 so that the upper tray 52 is mounted on the enamel coated metal turntable 44 to rotate in unison with the rotation of the turntable 44. The upper tray 52 is a metal mesh plate for supporting foodstuff 56 mounted thereon. Additional foodstuff 58 is mounted on the enamel coated metal turntable 44.

The cooking apparatus of the present invention further includes a circulation fan 60 for circulating heated air which performs the convection cooking operation. The circulation fan 60 is driven to rotate by a convection fan motor 62 via a pulley 64 and a drive belt 66 which is extended between the convection fan motor 62 and the pulley 64. An intake aperture 68 comprising a plurality of openings formed in the center of the ceiling wall 14 is provided to vent the air from the oven cavity 12 toward the circulation fan 60. A coil shaped sheath heater 70 is disposed to surround the circulation fan 60 in order to heat up the air drawn through the intake aperture 68. A first blowoff aperture, including a plurality of openings, 72 is formed in the ceiling wall 14 near the corner confronting the right side wall 20, and a second blowoff aperture, including a plurality of openings, 74 is formed in the left side wall 22 near the bottom end thereof. The intake aperture 68 and the first and second blowoff apertures 72 and 74 communicate with each other through a circulation duct 76 for effectively creating an air flow of the heated air as shown by arrows 78. The circulation duct 76 is secured to the ceiling wall 14 and the left side wall 22. The above-mentioned circulation fan 60 and sheath heater 70 are disposed in the circulation duct 76. The circulation fan 60 is located above the intake aperture 68 to effectively circulate the air from the oven cavity 12.

An air flow diverting plate 80 is disposed in the circulation duct 76 near the second blowoff aperture 74 to uniformly distribute the heated air flow within the oven cavity 12. An illumination lamp 82 is disposed in a clearance 84 formed between the housing 10 and the left side wall 22 to illuminate the oven cavity 12.

The circulation duct 76 must be located above the ceiling wall 14 and in the clearance 84 formed between the housing 10 and the left side wall 22, because the magnetron 28, the cooling fan 34, the fan motor 36 and the control circuit are disposed in the clearance 30 formed between the housing 10 and the right side wall 20. The magnetron 28, the cooling fan 34, the fan motor 36 and the control circuit must be protected from a high temperature.

As is well known, in the microwave cooking mode, the magnetron 28 generates microwave energy of 2,450 MHz. In the convection cooking mode, the cooking operation is performed by the heated air flow derived from the circulation fan 60 and the sheath heater 70. In the convection cooking mode, it will be clear from FIG. 1 that the foodstuff 56 mounted on the upper tray 52 is cooked by the heated air flow derived mainly from the first blowoff aperture 72, and the foodstuff 58 mounted on the turntable 44 (lower tray) is cooked by the heated air flow derived mainly from the second blowoff aperture 74. Since the foodstuffs 56 and 58 are rotated by the rotation of the turntable 44, a uniform cooking is ensured.

The turntable 44 can be a ceramic turntable instead of the enamel coated metal turntable.

The invention being thus described, it will be obvious that the same may be varied in many ways. Such variations are not to be regarded as a deparature from the spirit and scope of the invention, and all such modifications are intended to be included within the scope of the following claims.

What is claimed is:

1. A combination microwave oven and heated air circulating type oven which ensures uniform heating at different levels within an oven cavity which comprises:

an outer housing;

an oven cavity surrounded by a ceiling wall, a bottom wall and first and second side walls, said oven cavity disposed within said outer housing and defining a clearance therebetween;

upper support means and lower support means disposed in said oven cavity for supporting foodstuff to be cooked in the upper and lower portion of said oven cavity respectively, a magnetron disposed in said clearance and supplying microwave energy to said oven cavity through said ceiling wall;

an intake aperture formed near the center of the ceiling wall surrounding said oven cavity;

a first blowoff aperture formed in said ceiling wall near the corner confronting the first side wall of said oven cavity;

a second blowoff aperture formed in a lower portion of the second side wall of said oven cavity, said second side wall of said oven cavity, said second side wall defining the opposite side to said first side wall, the arrangement of said first blowoff aperture on one of the side walls being different from the arrangement of said second blowoff aperture on the other side wall;

circulation duct means disposed in said clearance and secured to said ceiling wall and said second side wall of said oven cavity for housing and providing communication between said intake aperture and said first and second blowoff apertures at the outside of said oven cavity, said intake aperture and said first and second blowoff apertures communicating with said circulating duct means;

circulating fan means for creating a forced air flow in said duct means from said intake aperture to said first and second blowoff apertures, said forced air flow being directed into said oven cavity through said first and second blowoff apertures; and heater means disposed in said duct means for heating up the forced air flow whereby the heated air generated from the first blowoff aperture heats up the upper surface of the foodstuff disposed on the upper support means and the lower surface of the foodstuff disposed on the lower support means and the heated air generated from the second blowoff aperture heats up the lower surface of the foodstuff disposed on the upper support means and the upper surface of the foodstuff disposed on the lower support means.

2. The combination microwave oven and heated air circulating type oven of claim 1, wherein said circulation fan means is disposed in said duct means and located above said intake aperture.

3. The combination microwave oven and heated air circulating type oven of claim 1, wherein the lower support means is a turntable and said second blowoff aperture is located at a height slightly higher than the surface of said turntable.

4. The combination microwave oven and heated air circulating type oven of claim 3 wherein the upper support means is an upper tray containing supporting legs which mount said upper tray on said turntable in such a fashion as to rotate in unison with the rotation of said turntable.

5. The combination microwave oven and heated air circulating type oven of claim 3, wherein said turntable comprises an enamel coated metal turntable removably coupled to a rotation drive source.

6. The combination microwave oven and heated air circulating type oven of claim 1, wherein an air flow diverting plate is operatively associated with the second blowoff aperture to effectively distribute the heated airflow between the upper and lower support means.

* * * * *